US006386119B1

(12) United States Patent
Lin

(10) Patent No.: US 6,386,119 B1
(45) Date of Patent: May 14, 2002

(54) FOLDABLE LEG FOR FURNITURE

(75) Inventor: Han-Chang Lin, Chang Hua Hsien (TW)

(73) Assignee: Kae Chih Enterprises Co., Ltd., Chang Hua Hsien (TW)

( * ) Notice: Subject to any disclaimer, the term of this patent is extended or adjusted under 35 U.S.C. 154(b) by 0 days.

(21) Appl. No.: 09/945,426

(22) Filed: Aug. 31, 2001

(30) Foreign Application Priority Data

Oct. 19, 2000 (TW) ..... 089218081

(51) Int. Cl.[7] ..... A47B 3/00
(52) U.S. Cl. ..... 108/133; 108/129
(58) Field of Search ..... 108/131, 132, 108/133, 129

(56) References Cited

U.S. PATENT DOCUMENTS 4,838,181 A * 6/1989 Lukt ..... 108/131
5,323,713 A * 6/1994 Lukt et al. ..... 108/131
5,845,589 A * 12/1998 Pfister ..... 108/133

FOREIGN PATENT DOCUMENTS

CH 172682 * 10/1934 ..... 108/131
FR 1079438 * 11/1954 ..... 108/133

* cited by examiner

*Primary Examiner*—Peter M. Cuomo
*Assistant Examiner*—Jerry A. Anderson
(74) *Attorney, Agent, or Firm*—Thorp Reed & Armstrong, LLP

(57) ABSTRACT

A foldable leg for furniture includes a tubular leg and a pivot assembly attached to a top of the tubular leg. The pivot assembly includes a front plate and two wing plates respectively perpendicularly extending from two opposite sides of the front plate and facing each other. Each of the wing plates has a curved top edge and an elongated slot longitudinally defined in each of the wing plates. A bracket is pivotally connected to the pivot assembly and includes two side plates parallel to each other, and each has a through hole defined in a lower portion of the side plate. A locking plate connects the two side plates and the locking plate is selectively locked by the pivot assembly. A spring has two ends respectively secured around the pivot pin and at a free end of the tongue of the pivot assembly.

10 Claims, 7 Drawing Sheets

FOLDABLE LEG FOR FURNITURE

BACKGROUND OF THE INVENTION

1. Field of the Invention

The present invention relates to a foldable leg, and more particularly to a foldable leg for furniture, such as a table, a chair or the like.

2. Description of Related Art

With reference to FIGS. 5 and 6, a conventional foldable leg for furniture in accordance with the prior art is used to support a tabletop (60) and comprises two connecting bars (61), brackets (62), legs (63), locking arms (65), drive bars (67) The tabletop (60) has a top, a bottom and an edge. The connecting bars (61) are parallel to each other, have two ends on each bar (61) and are attached to opposite sides of the bottom of the tabletop (60). A bracket (62) is attached to each end of each connecting bar (61). Each leg (63) has one end pivotally connected to a bracket (62) and the other end stands on a surface, such as a floor or the ground. Each locking arm (65) has one end pivotally attached to a connecting bar (61) the other end is connected by a drive bar (67). A groove (66) is longitudinally defined in the locking arm (65). A locking pin (64) extends from the leg (63) into the groove (66) in the locking arm (65).

A folding metal shelf (69) has four edges, a skirt (not numbered) extending downward from each edge and four guiding grooves (690) defined in the skirt and corresponding to the locking arms (65). Each of the locking arms (65) has a locking pin (68) extending into the corresponding guiding groove (690) to hold the folding shelf (69).

With reference to FIGS. 6 and 7, to operate the conventional foldable leg, the user must push the drive bar (67) to make two legs (63) corresponding to the ends of the drive bar (67) pivot inward. As the legs (63) pivot inward, the locking pins (64) on the legs (63) move along the grooves (66) in the corresponding locking arms (65) and pivot the locking arms (65) toward the connecting bars (61). The other locking pin (68) in the locking arm (65) slides in the guiding groove (690) and lifts the folding shelf (69) toward the bottom of the tabletop (60). When the legs (63) are completely folded against the tabletop (60) the folding shelf (69) is held against the bottom of the tabletop (60) between the connecting bars (61).

However, the conventional foldable leg for furniture has the follow disadvantages.

1. It is inconvenient to use. Two corresponding legs (63) must be folded at the same time, otherwise the locking arm (65) and the leg (63) will be seized.

2. Striking the drive bar (67) to make the locking pin (64) of the leg (63) escaping from the dead point will be painful to the user's hand.

3. The drive bar (67) will deform if the user strikes the drive bar (67) with his leg to prevent his hand from hurting.

The present invention has arisen to mitigate and/or obviate the disadvantages of the conventional foldable leg for furniture.

SUMMARY OF THE INVENTION

The main objective of the present invention is to provide an improved foldable leg for furniture that is easy to operated and can be used in more applications.

To achieve the objective, the foldable leg for furniture in accordance with the present invention comprises a tubular leg with a top and bottom end and a pivot assembly attached to the top end of the tubular leg. The pivot assembly includes a front plate with two sides and two wings perpendicularly extending from opposite sides of the front plate and facing each other. Each of the wings has a top forming a guiding side and an elongated slot defined longitudinally in each of the wings. A bracket is pivotally connected to the pivot assembly and includes two parallel side plates and each has a through hole defined in a lower portion of the side plate. A locking plate connects the two side plates and the locking plate selectively locked by the pivot assembly. A spring has two ends respectively secured on the pivot pin and a free end of the tongue of the pivot assembly.

Further benefits and advantages of the present invention will become apparent after a careful reading of the detailed description with appropriate reference to the accompanying drawings.

DETAILED DESCRIPTION OF THE INVENTION

Figure 1:
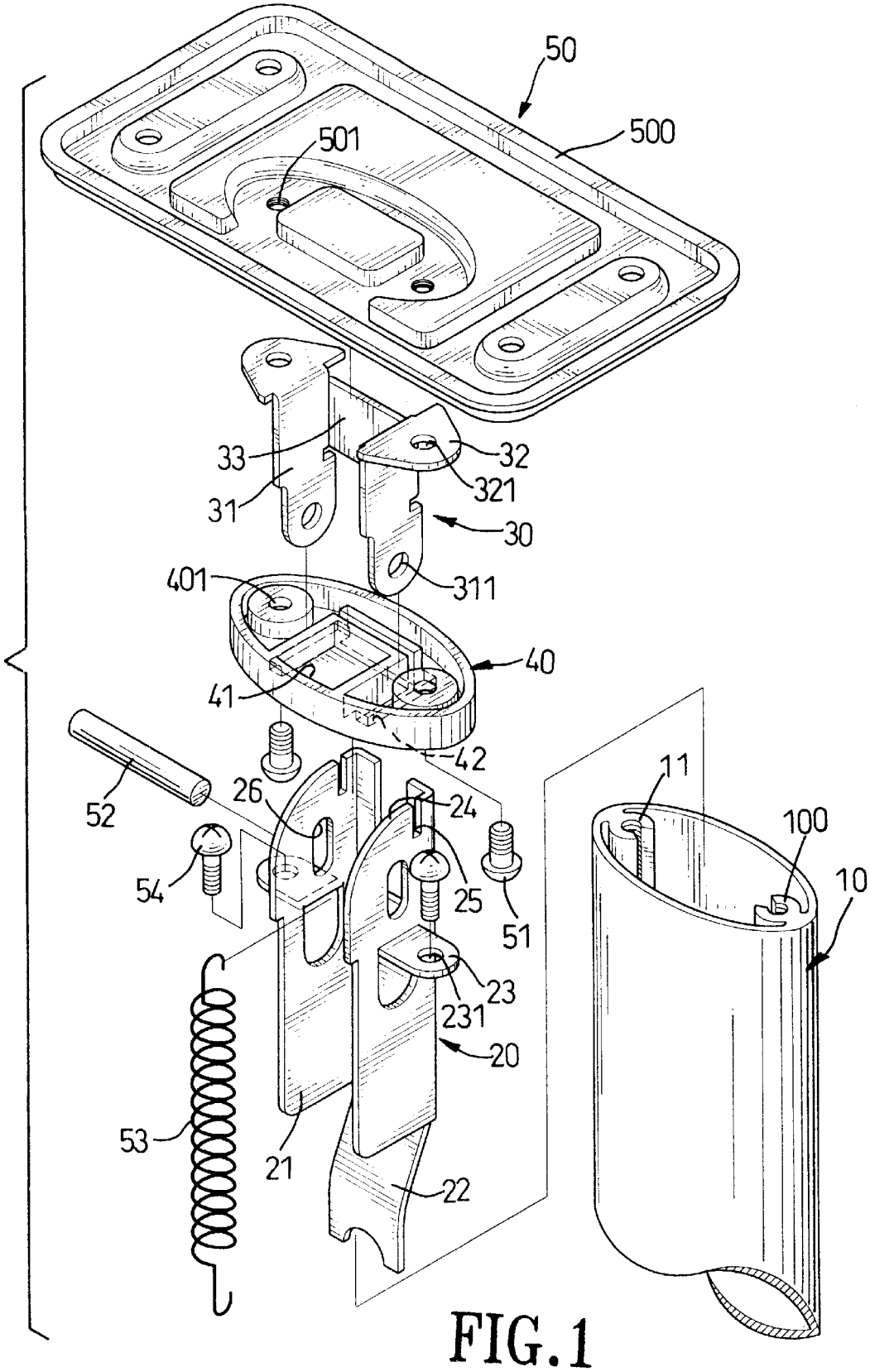
FIG. 1 is an exploded perspective view of a foldable leg for furniture in accordance with the present invention.
Figure 2:
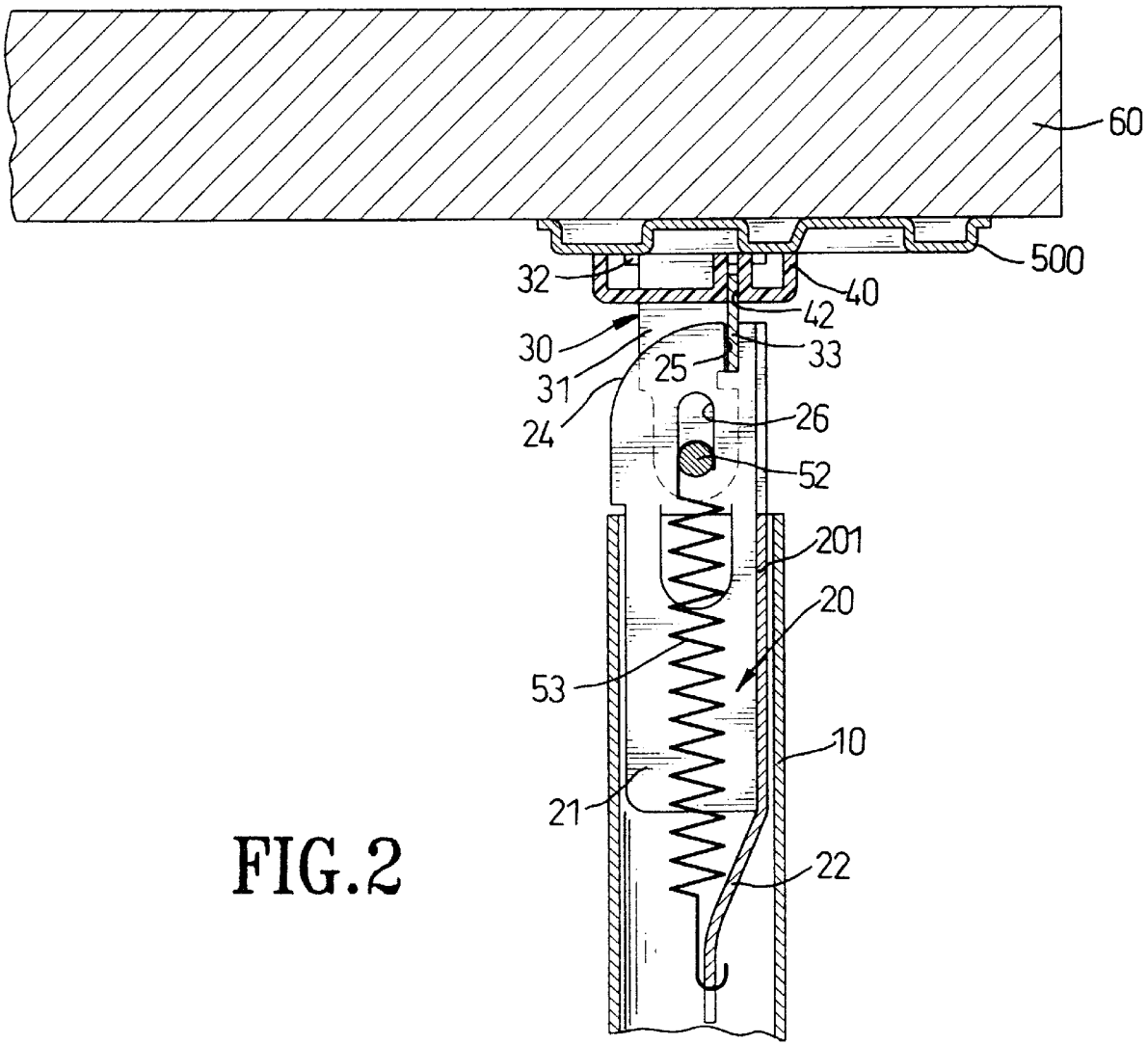
FIG. 2 is a cross sectional side plan view of the foldable leg for furniture in FIG. 1.

With reference to FIGS. 1 and 2, a foldable leg for furniture in accordance with the present invention comprises a tubular leg (10), a pivot assembly (20), a bracket (30), a brace (40) and a mounting plate (50). The tubular leg (10) can be used with furniture such as tables, chairs, utility stands, etc. The pivot assembly (20) is partially received in the tubular leg (10). The bracket (30) is pivotally connected to the pivot assembly (20). The brace (40) is mounted between the pivot assembly (20) and the bracket (30).

The tubular leg (10) has a hollow interior with an inner periphery. Two longitudinal split ribs (100) are defined on opposite sides of the inner periphery of the tubular leg (10), and a threaded holes ( 11) is defined in each of the split ribs (100).

The pivot assembly (20) is U-shaped and comprises an integral front plate (201) and two parallel wing plates (21). The front plate (201) has a left and right edge, and the wing plates (21) respectively extend perpendicular from the left and right edge of the front plate (201). Each of the wing plates (21) has a curved top edge (24) and an ear (23) extending perpendicular out from the wing plate (21) and corresponding to the split rib (100) in the tubular leg (10). A through hole (231) is defined in the ear (23) of the pivot assembly (20) to correspond to the threaded hole (11) of the tubular leg (10). A tongue (22) with a bottom edge extends downward from the front plate (201) and has a notch (not numbered) formed in the bottom edge. Each wing plate (21) has a locking groove (25) defined in the curved top edge (24) and an elongated slot (26) longitudinally defined in the wing plate (21) above the ear (23).

The bracket (30) comprises two side plates (31) pivotally connected to the wing plates (21) of the pivot assembly (20) and a locking plate (33) integrally connected to an upper portion of the two side plates (31). Each side plate (21) has an inside surface facing the other side plate (21) and an upper edge. The distance between the two side plates (3 1) of the bracket (30) is slightly greater than the distance between the two wing plates (21) of the pivot assembly (20). The inside surfaces of the side plates (31) rub against the outside surfaces of the wing plates (21), and the locking plate (33) is selectively received in the locking groove (25). An ear (32) laterally extends from the top of the side plate (31) of the bracket (30) and is connected to the mounting plate (50). A through hole (321) is defined in the ear (32) of the bracket (30), and a pivot hole (311) is defined near a lower end of the side plate (31) of the bracket (30).

The brace (40) comprises a U-shaped groove (42) defined in a middle portion of the brace (40) to allow the side plates (31) and the locking plate (33) to extend through the brace (40). The brace (40) has two through holes (401) respectively defined near the two opposite ends of the brace (40) and corresponding to the through holes (321) in the ears (32) of the bracket (30).

The mounting plate (50) comprises a seat (500) adapted to be secured on a piece of furniture (60), such as a chair, a table and the like. Two threaded holes (501) are defined in the seat (500) and correspond to the through holes (321) in the ears (32) of the bracket (30). Two bolts (51) respectively extend through the through holes (401, 321) of the brace (40) and the bracket (30) and are screwed into the threaded hole (501) in the seat (500) to hold the brace (40) and the bracket (30) in place.

The pivot assembly (20) is attached to the tubular leg (10) by passing bolts (54) through the through holes (231) in the ears (23) of the pivot assembly (20) and screwing the bolts (54) into the threaded holes (11) in the split ribs (100) inside the tubular leg (10). A pivot pin (52) extends through the through holes (311) in the side plate (31) in the bracket (30) and the elongated slots (26) in the wing plates (21) of the pivot assembly (20) to pivotally connect the bracket (30) to the pivot assembly (20). A spring (53) has two opposite ends respectively attached to the pivot pin (52) and of the notch in the tongue (22) to keep the tubular leg (10) from inadvertently folding by holding the locking plate (33) in the locking groove (25) in the pivot assembly (20).

Figure 3:
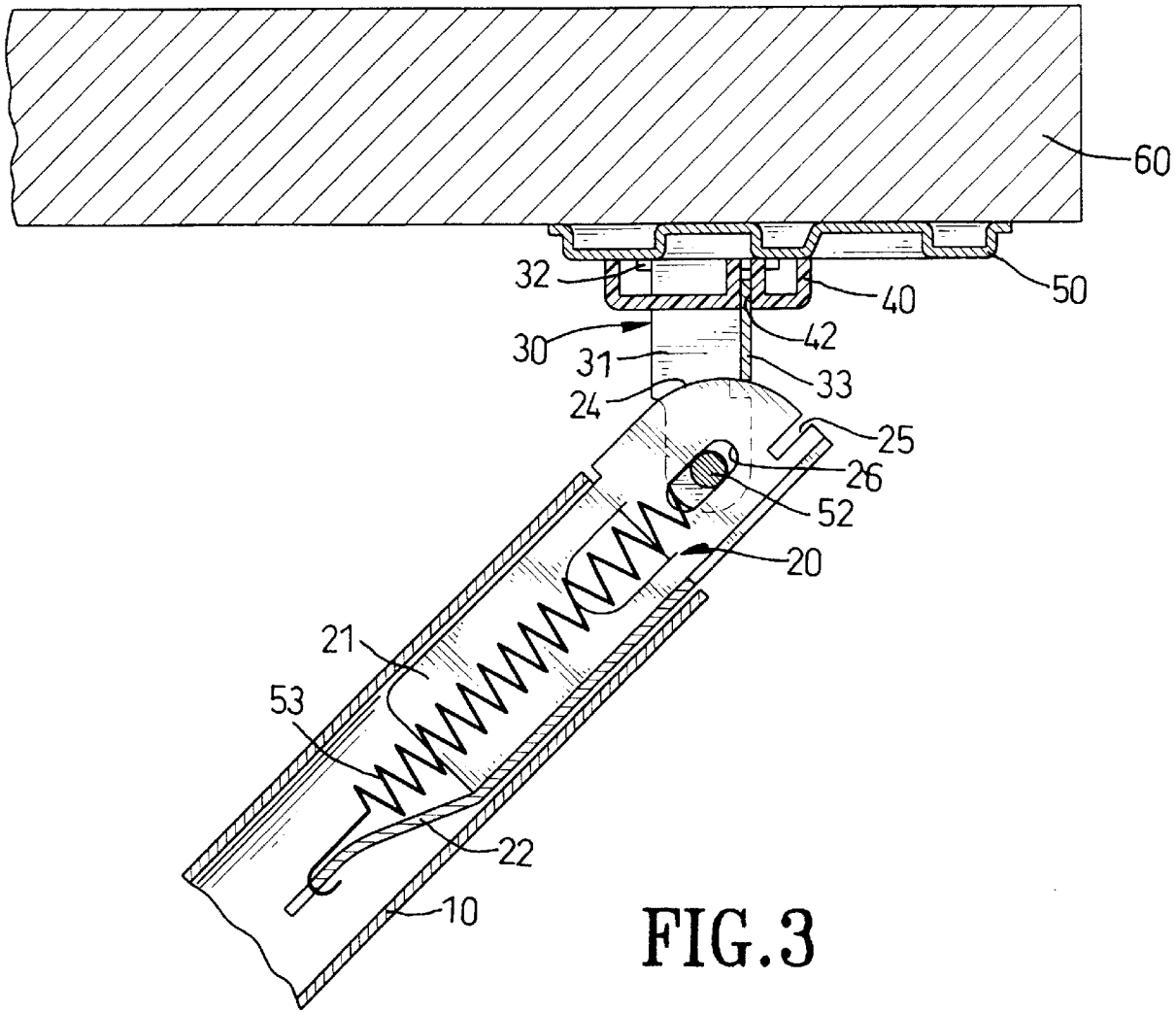
FIG. 3 is an operational cross sectional side plan view of the foldable leg in FIG. 2.
Figure 4:
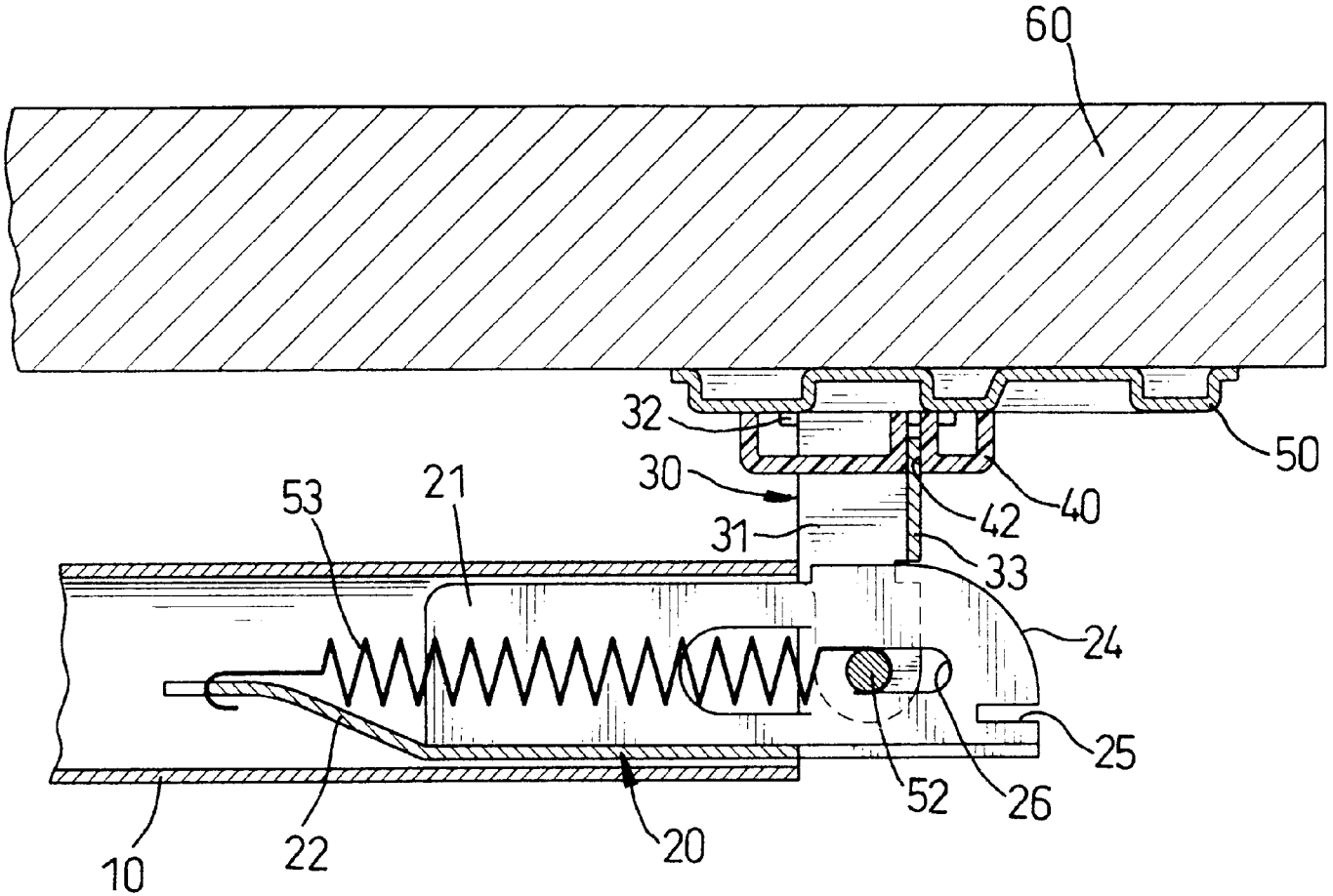
FIG. 4 is an operational cross sectional side plan view of the foldable leg in FIG. 2 when the leg is folded.
Figure 5:
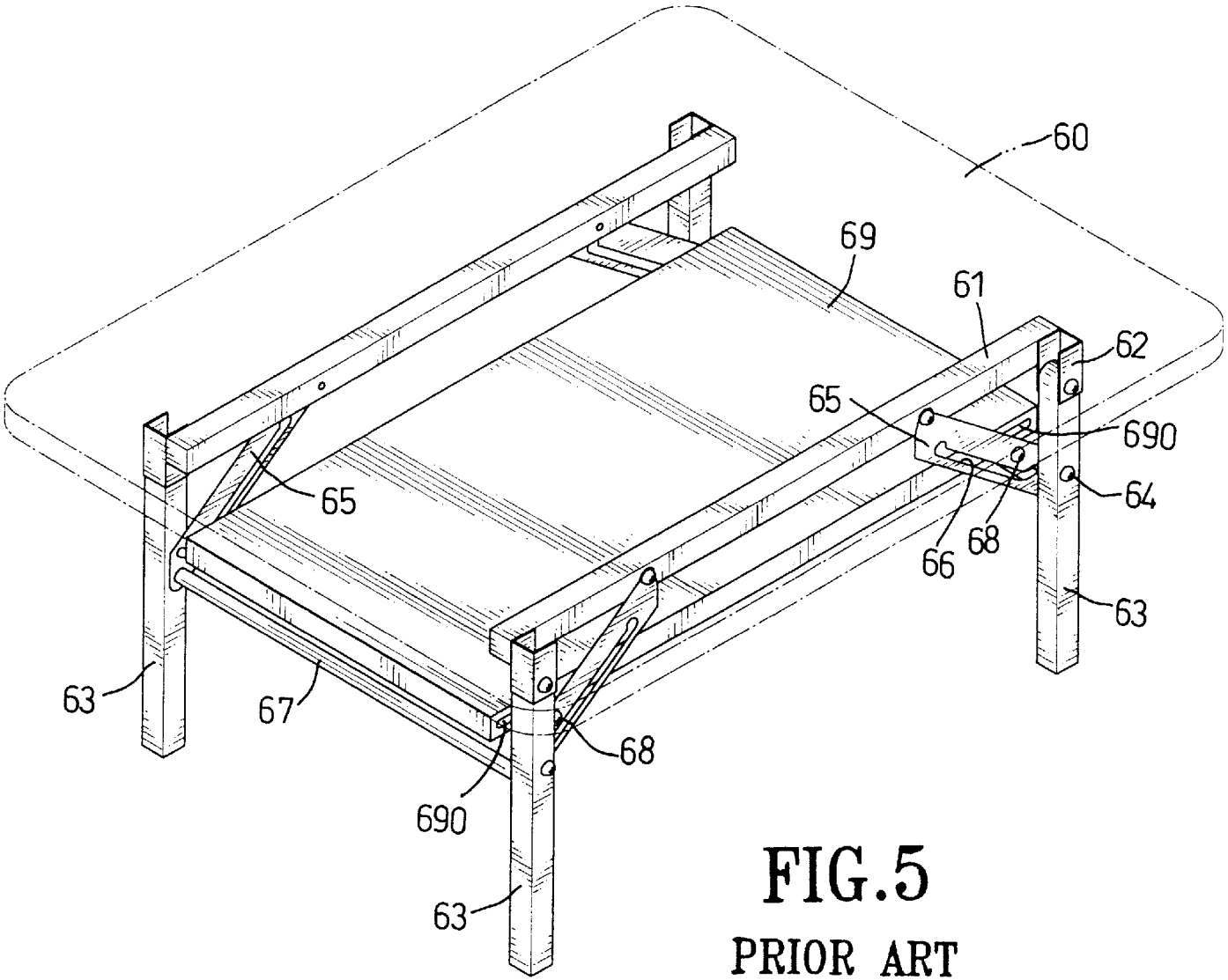
FIG.5 PRIOR ART
FIG. 5 is a perspective view of a conventional foldable leg for furniture in accordance with the prior art.
Figure 6:
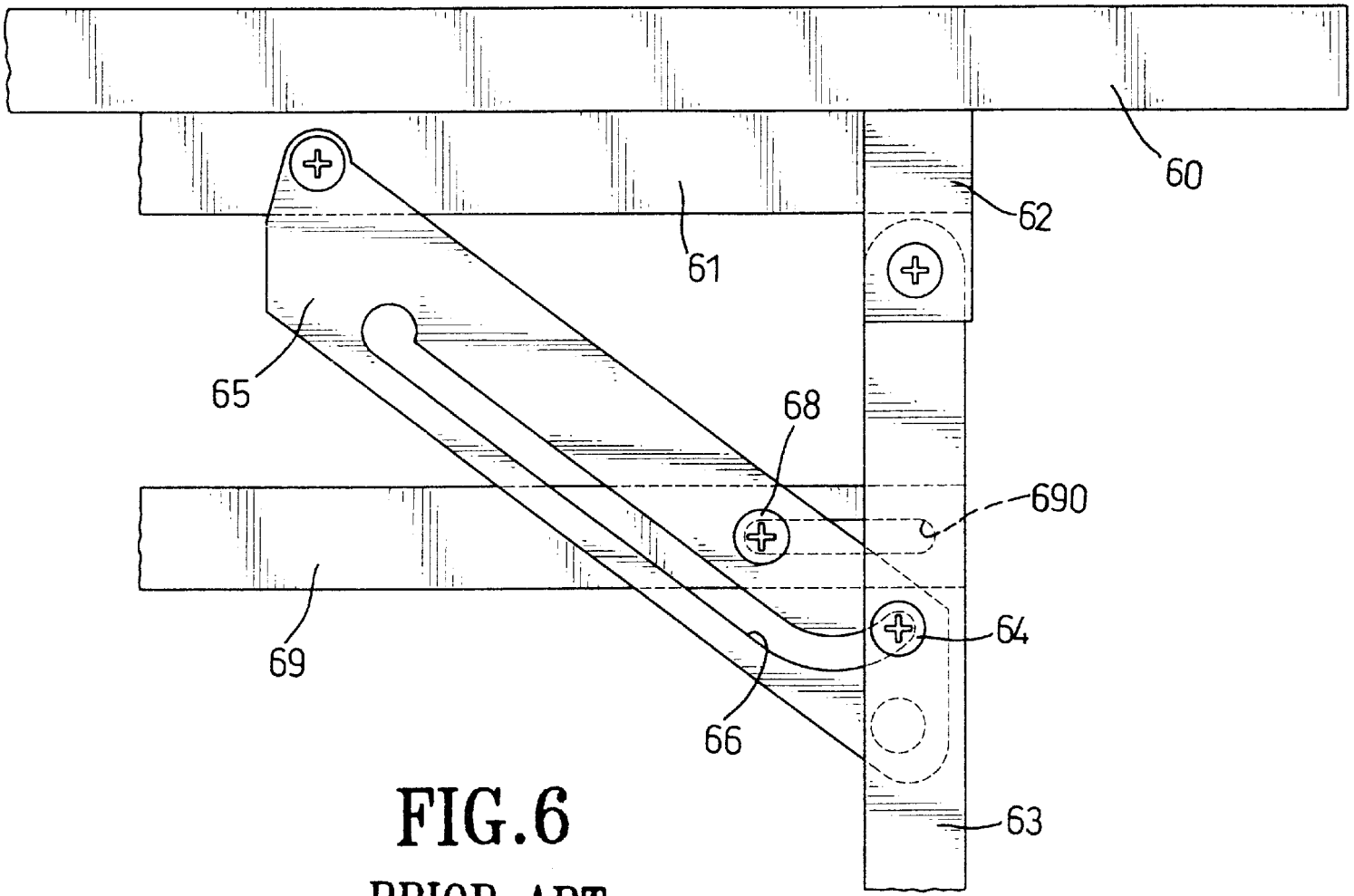
FIG.6 PRIOR ART
FIG. 6 is a side plan view of the conventional foldable leg in FIG. 5.
Figure 7:
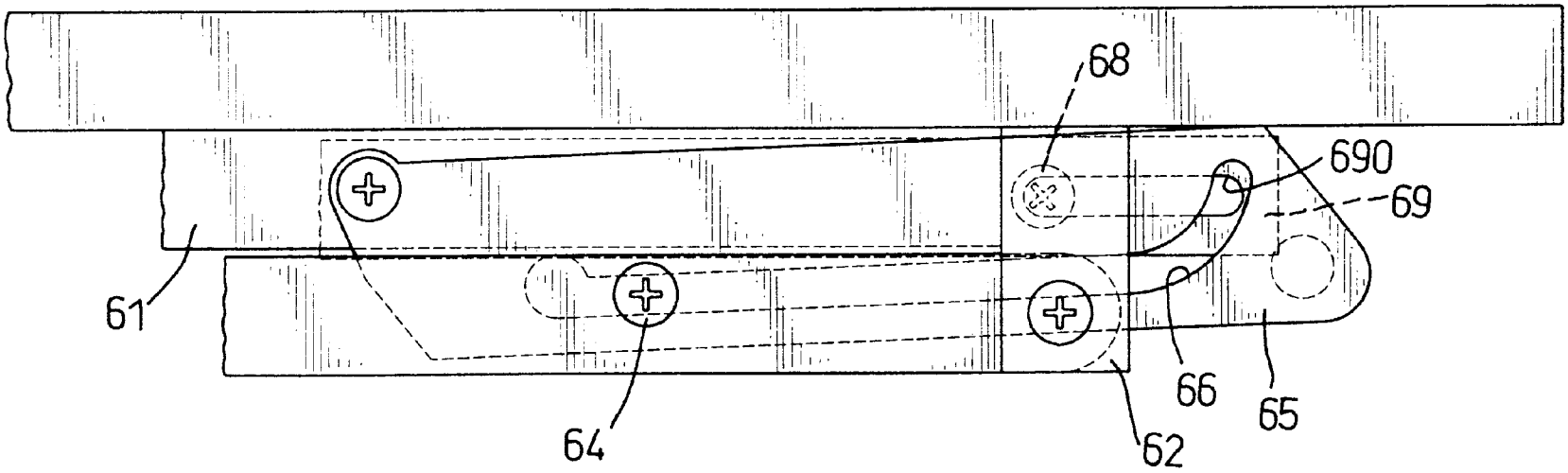
FIG. 7 PRIOR ART
FIG. 7 is a side plan view of the conventional foldable leg in FIG. 5 when the leg is folded.

With reference to FIGS. 2, 3 and 4, the foldable leg is folded by pulling the tubular leg (10) downward relative to the seat (500) of the mounting plate (50) to release the locking plate (33) of the bracket (30) from the locking groove (25) in the pivot assembly (20). The pivot pin (52) is moved from a lower portion to an upper portion in the elongated slot (26) in the wing plate (21) of the pivot assembly (20), and the spring is stretched. The locking plate (33) of the bracket (30) abuts and slides along the curved top edge (24) of the wing plate (21) as the foldable leg is pivoted and folded. The pivot pin (52) returns to the lower portion of the elongated slot (26) when the foldable leg is parallel to the bottom of the tabletop (60). The restitution force of the spring (53) holds the tubular leg (10) in the stowed position.

As described, the foldable leg for furniture in accordance with the present invention has the following advantages.

1. It is easy to operate and fold. The foldable leg of the present invention is easily folded just by pulling the tubular leg (10) downward to release the locking plate (33) from the locking groove (25). Furthermore, is can be operated quickly.

2. The foldable leg of the present invention can be operated individually so the structure can never seize.

3. The scope of use is wider than that of the conventional foldable leg. The foldable leg of the present invention can be used to support a chair, a table or any other furniture that needs a support.

Although the invention has been explained in relation to its preferred embodiment, it is to be understood that many other possible modifications and variations can be made without departing from the spirit and scope of the invention as hereinafter claimed.

What is claimed is:

1. A foldable leg for furniture comprising:

a tubular leg;

a pivot assembly partially mounted in the tubular leg and secured on a top of the tubular leg, the pivot assembly including:

a front plate;

two wing plates perpendicularly extending from two opposite sides of the front plate and facing each other, each of the wing plates having a curved top edge and forms a guiding edge and an elongated slot longitudinally formed in each of the wing plate;

locking groove defined at a top of the curved top edge of the wing plate; and a tongue extending downwardly from the front plate of the pivot assembly with a notch in the bottom of the tongue;

a bracket pivotally connected to the pivot assembly and including:

two side plates parallel to each other and each having a through hole defined in a lower portion of the side plate, a distance between the two side plates lightly greater than that between the two wing plates of the pivot assembly; and a locking plate connecting the two side plates and the locking plate selectively received in the locking groove in the wing plate of the pivot assembly when the tubular leg is adapted to stand the furniture;

a pivot pin extending through the elongated slot in the wing plate of the pivot assembly and the through hole in the side plate of the bracket to pivotally connect the assembly and the bracket; and a spring having two ends respectively secured around the pivot pin and in the notch in a free end of the tongue of the pivot assembly.

2. The foldable leg for furniture as claimed in claim 1, wherein the tubular leg comprises two opposite split ribs longitudinally extending from an inner periphery of the tubular leg and a threaded hole longitudinally defined in the split rib;

each of the wing plates of the pivot assembly comprises an ear laterally extending out from the wing plate and having a threaded hole defined to correspond to the threaded hole in the tubular leg; and a bolt extends through the through hole in the ear of the wing plate and is screwed into the threaded hole in the tubular leg to hold the pivot assembly in place.

3. The foldable leg for furniture as claimed in claim 1 further comprising a brace mounted on the bracket and having a U-shaped groove defined to allow the side plates and the locking plate of the bracket to extend through brace.

4. The foldable leg for furniture as claimed in claim 2 further comprising a brace mounted on the bracket and having a U-shaped groove defined to allow the side plates and the locking plate of the bracket to extend through brace.

5. The foldable leg for furniture as claimed in claim 3 further comprising a seat having two threaded holes defined in the seat, a first side adapted to attach to a bottom surface of a piece of furniture and a second side to mount the bracket on the seat.

6. The foldable leg for furniture as claimed in claim 4 further comprising a seat having two threaded holes defined in the seat, a first side adapted to attach to a bottom surface of a piece of furniture, a second side to mount the bracket on the seat.

7. The foldable leg for furniture as claimed in claim 5, wherein the side plates of the bracket each comprises an ear laterally extending out from a top of the side plate and having a through hole defined to align with a corresponding threaded hole in the seat; and the brace comprises two through holes respectively defined to align with a corresponding threaded hole in the seat.

8. The foldable leg for furniture as claimed in claim 6, wherein the side plates of the bracket each comprises an ear laterally extending out from a top of the side plate and having a through hole defined to align with a corresponding threaded hole in the seat; and the brace comprises two through holes respectively defined to align with a corresponding threaded hole in the seat.

9. The foldable leg for furniture as claimed in claim 7 further comprising two bolts respectively extending through the through holes in the brace and the bracket and screw into the threaded holes in the seat to hold the brace and the bracket in place.

10. The foldable leg for furniture as claimed in claim 8 further comprising two bolts respectively extending through the through holes in the brace and the bracket and screw into the threaded holes in the seat to hold the brace and the bracket in place.

* * * * *